US008031901B2

(12) United States Patent
Levitsky

(10) Patent No.: US 8,031,901 B2
(45) Date of Patent: Oct. 4, 2011

(54) PLANAR SPEAKER DRIVER

(75) Inventor: Igor Levitsky, Toronto (CA)

(73) Assignee: Bohlender Graebener Corporation, Carson City, NV (US)

( * ) Notice: Subject to any disclaimer, the term of this patent is extended or adjusted under 35 U.S.C. 154(b) by 1055 days.

(21) Appl. No.: 11/855,146

(22) Filed: Sep. 13, 2007

(65) Prior Publication Data

US 2008/0069394 A1 Mar. 20, 2008

Related U.S. Application Data

(60) Provisional application No. 60/825,690, filed on Sep. 14, 2006.

(51) Int. Cl.
*H04R 1/00* (2006.01)

(52) U.S. Cl. ..... 381/399; 381/190; 381/191; 381/423

(58) Field of Classification Search ..... 381/399, 381/190, 191, 423
See application file for complete search history.

(56) References Cited

U.S. PATENT DOCUMENTS 3,919,499 A * 11/1975 Winey ..... 381/408
3,939,312 A * 2/1976 McKay ..... 381/408
4,049,926 A * 9/1977 Kasatkin et al. ..... 381/399
4,210,786 A * 7/1980 Winey ..... 381/408
4,337,379 A * 6/1982 Nakaya ..... 381/408
4,471,172 A * 9/1984 Winey ..... 381/427
4,471,173 A * 9/1984 Winey ..... 381/408
4,480,155 A * 10/1984 Winey ..... 381/408
4,653,103 A * 3/1987 Mori et al. ..... 381/99
4,837,838 A * 6/1989 Thigpen et al. ..... 381/408
5,021,613 A * 6/1991 Garcia ..... 381/399
5,081,683 A * 1/1992 Torgeson ..... 381/182
5,317,305 A * 5/1994 Campman ..... 340/573.1
5,430,805 A * 7/1995 Stevenson et al. ..... 381/408
5,473,700 A * 12/1995 Fenner, Jr. ..... 381/336
5,850,461 A * 12/1998 Zelinka ..... 381/398
5,912,863 A * 6/1999 Bengtsson ..... 367/174
5,953,438 A * 9/1999 Stevenson et al. ..... 381/431
6,104,825 A * 8/2000 Thigpen ..... 381/408
6,629,922 B1 * 10/2003 Puria et al. ..... 600/25
6,760,462 B1 * 7/2004 Thigpen ..... 381/431
6,810,126 B2 * 10/2004 Levitsky ..... 381/191
6,934,402 B2 * 8/2005 Croft et al. ..... 381/412
7,088,837 B2 * 8/2006 Von Hellermann et al. .. 381/191
7,099,488 B2 * 8/2006 Bohlender ..... 381/408
7,142,688 B2 * 11/2006 Croft et al. ..... 381/431
7,146,019 B2 12/2006 Levitsky
7,152,299 B2 * 12/2006 Mango et al. ..... 29/594
7,174,024 B1 * 2/2007 Suzuki et al. ..... 381/152
7,231,058 B2 * 6/2007 Usuki et al. ..... 381/412
7,251,342 B2 * 7/2007 Graebener ..... 381/431
7,450,729 B2 * 11/2008 Nguyen et al. ..... 381/152
7,903,834 B1 * 3/2011 Graber ..... 381/336
7,912,241 B1 * 3/2011 Graber ..... 381/431
7,929,725 B2 * 4/2011 Sugiura et al. ..... 381/399
2001/0005419 A1 * 6/2001 Kermani et al. ..... 381/189
2002/0021821 A1 * 2/2002 Tanase et al. ..... 381/431
2002/0057822 A1 * 5/2002 Kermani et al. ..... 381/427

(Continued)

*Primary Examiner* — David S. Warren
(74) *Attorney, Agent, or Firm* — Fenwick & West LLP

(57) ABSTRACT

A planar magnetic driver includes covering plates that are maintained under tension to form a buckled or curved surface, thereby providing for a larger magnetic gap, and allowing for a larger excursion of the diaphragm and extended lower frequency response. Another aspect of the driver includes a corrugated region along the periphery of the diaphragm, which provides increased internal dampening.

7 Claims, 5 Drawing Sheets

U.S. PATENT DOCUMENTS

2002/0061116 A1* 5/2002 Hara et al. ..... 381/413
2002/0076069 A1* 6/2002 Norris et al. ..... 381/191
2002/0118856 A1* 8/2002 Croft et al. ..... 381/412
2002/0191808 A1* 12/2002 Croft et al. ..... 381/431
2003/0076977 A1* 4/2003 Levitsky ..... 381/431
2003/0228029 A1* 12/2003 Graebener ..... 381/432
2004/0022409 A1* 2/2004 Hutt et al. ..... 381/423
2004/0022410 A1* 2/2004 Bohlender ..... 381/431
2004/0042632 A1* 3/2004 Hutt et al. ..... 381/423
2004/0136558 A1* 7/2004 Usuki et al. ..... 381/394
2004/0170296 A1* 9/2004 Von Hellermann ..... 381/421
2005/0002536 A1* 1/2005 Gorelik et al. ..... 381/150
2005/0031153 A1* 2/2005 Nguyen et al. ..... 381/414
2005/0036646 A1* 2/2005 Garner et al. ..... 381/412
2005/0041830 A1* 2/2005 Takewa et al. ..... 381/410
2005/0135653 A1* 6/2005 Steere et al. ..... 381/431
2005/0157904 A1* 7/2005 Steere et al. ..... 381/431
2006/0023902 A1* 2/2006 Thigpen ..... 381/176
2006/0050923 A1* 3/2006 Croft et al. ..... 381/421
2007/0098207 A1* 5/2007 Lin ..... 381/399
2007/0110269 A1* 5/2007 Levitsky ..... 381/335
2008/0219469 A1* 9/2008 Simidian et al. ..... 381/92

* cited by examiner

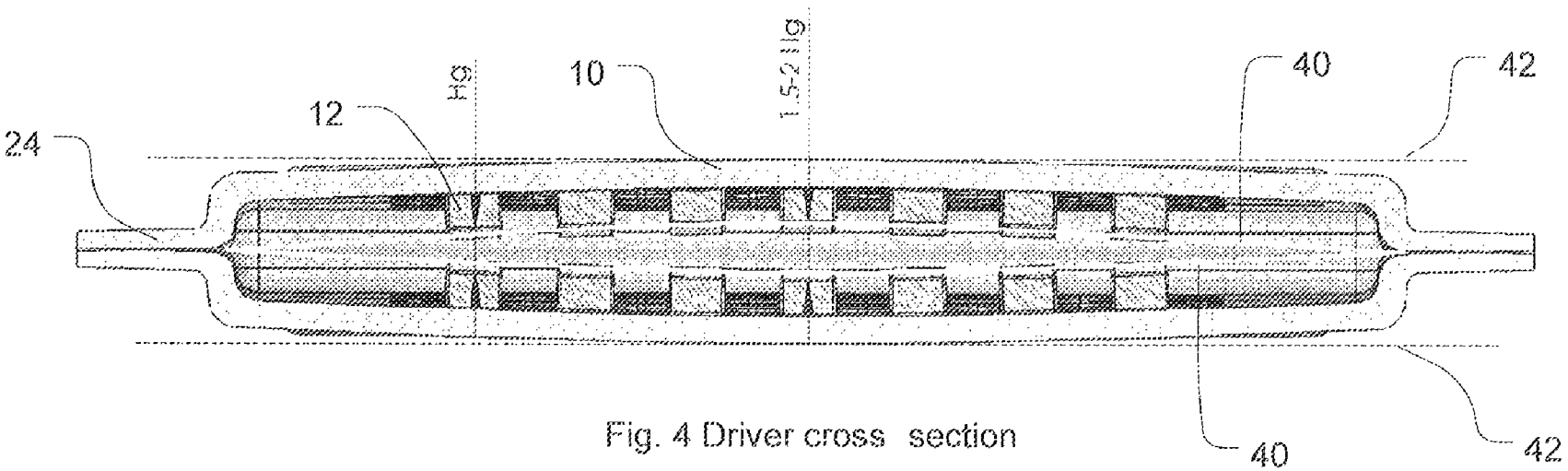
Fig. 4 Driver cross section

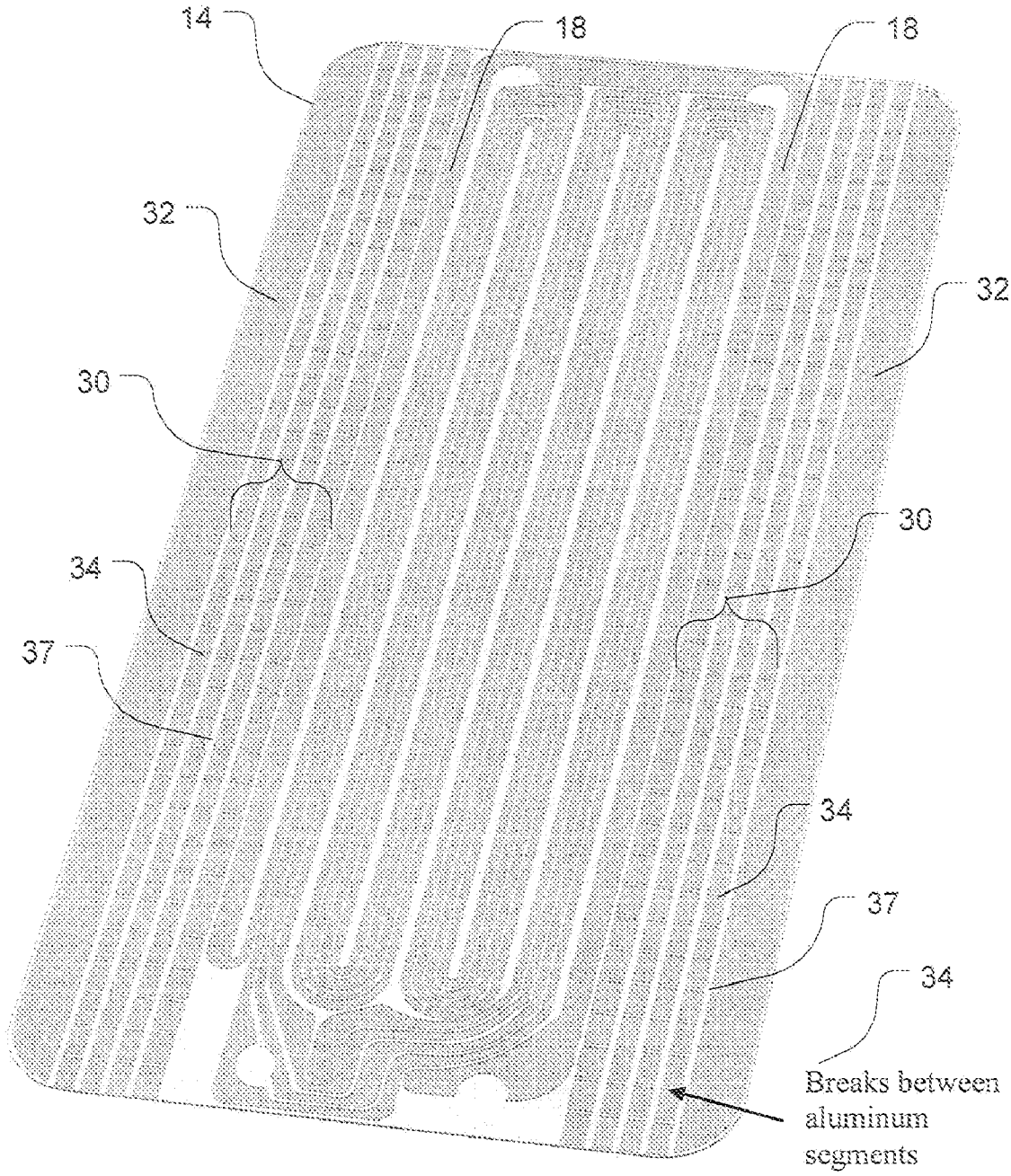
Fig. 5 Diaphragm prior to corrugation

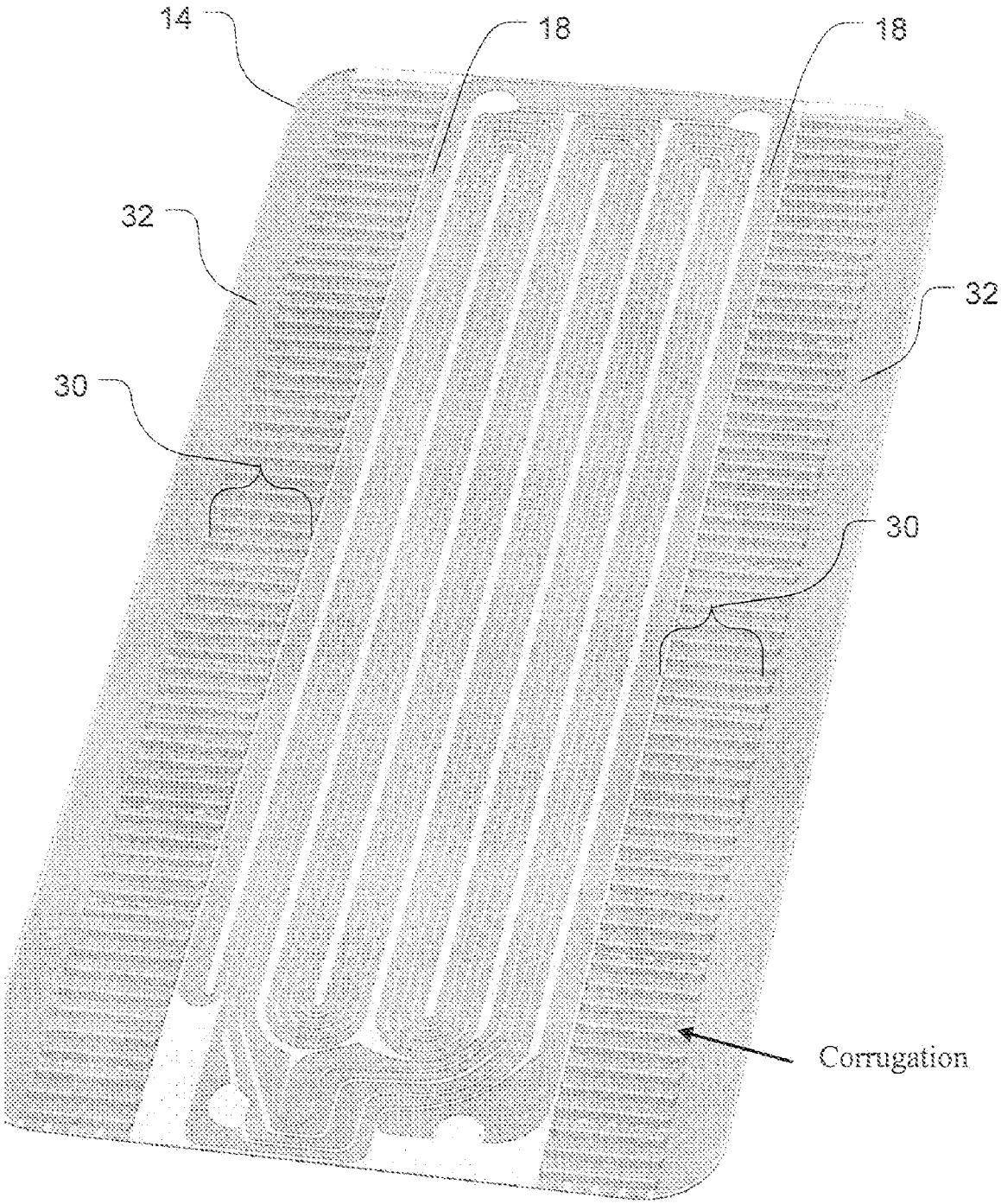
FIG. 6 Diaphragm after corrugation

PLANAR SPEAKER DRIVER

CROSS-REFERENCE TO RELATED APPLICATION

This application claims priority from U.S. Provisional Application No. 60/825,690 entitled "Planar Speaker Driver" filed on Sep. 14, 2006, the content of which is incorporated by reference herein in its entirety.

BACKGROUND

1. Field of the Art

The present invention generally relates to acoustic devices, and more specifically to a planar speaker driver.

2. Description of the Related Art

Planar (planar-magnetic, ribbon, thin film drivers) drivers have always been praised for exceptional sound quality associated with their unique acoustic attributes. This invention describes a wide-band planar transducer with high sensitivity, extended lower frequency operating band, higher power handling and low distortion.

FIG. 1 illustrates a cross-section showing a basic construction of a typical planar-magnetic transducer. A common type of such transducer incorporates a diaphragm 1 with areas of multiple electrical conductors 2. A diaphragm 1 is clamped in a frame 5 and is positioned between two rows of magnet bars 3. Magnets are sequentially located on top and bottom metal plates 4 with spaced areas 7 between the magnets. Holes 6 in metal plates 4 correspond to the spaced areas 7 between magnets 3, acoustically connecting diaphragm 1 with outside media.

Magnets 3 are magnetized in a direction perpendicular to metal plate 4 so that a magnet from one side of a diaphragm and the opposite magnet from the other side of diaphragm are facing diaphragm and each other with the same magnetic poles (S or N). Each adjacent magnet bar that is located on the same side of the diaphragm has the opposite direction of magnetization, thus each following magnet faces the diaphragm with the opposite magnetic pole, following the sequence N,S,N,S,N and so on. Magnetic field created by the magnet arrangement has the magnetic flux vector B in a plane of the diaphragm across the lines of conductors.

When an electrical signal is applied to the diaphragm, the current that flows through conductors interacts with the magnetic field and resulting electromotive force makes the diaphragm vibrate in the direction perpendicular its plane. Vibrating, the diaphragm 1 radiates sound waves that emanate through the openings 7 between magnets 3 and holes 6 in metal plates 4 in both directions from the diaphragm 1. Different acoustical loading conditions may be applied to the design such as using a metal plate 4 with variations in the holes 6 (e.g., slots, or solid regions) or attaching an enclosure form one side of a transducer.

The use of rear earth magnetic materials such as NdFeB (Neodymium) that has become the magnet material of choice in transducers recent years, allows significant reduction of size and efficiency improvement of transducer designs. As a result such designs can provide very high quality sound with minimal front to back space required, thus allowing building of "flat" panel planar loudspeakers for many critical applications.

Among performance limitations traditionally associated with planar drivers are limited low frequency extension and limited dynamic range at those frequencies. Both of these issues are mostly related to two aspects of driver design and operation: maximum diaphragm excursion capability and vibration behavior of the diaphragm within the operating range.

In order to extend effective frequency range of such design in a region of lower frequencies, a transducer has to have significant radiating area. However, a larger diaphragm has much less vibration control and generates significant modal vibrations due to insufficient mechanical losses in diaphragm substrate, usually plastic film. These pronounced vibrations at diaphragm resonance frequencies lead to response irregularities and parasitic noises at lower frequencies that are very often encountered in planar transducers.

Many designs use coating of the diaphragm with dampening materials and/or corrugation over the whole diaphragm area. Both of these methods have negative effects. A coating leads to higher mass and efficiency losses. Corrugation of the entire diaphragm increases the effective thickness of the diaphragm where active conductions are located and thus limits maximum excursion of the diaphragm. Additionally the corrugation of diaphragm in the area of active conductors that are made of very thin metal foil can introduce internal stresses in the conductor and/or in the bond between polymer film and the foil conductor. Under high thermal and mechanical stress due to vibrations the internal stresses can then lead to premature de-lamination or cracks in the conductors.

SUMMARY OF THE INVENTION

A planar transducer with extended low frequency operational band and high efficiency is disclosed. In one aspect the planar transducer has top and bottom plates that are maintained in a curved (buckled) or arcuate shape due to mechanical tension placed across their surfaces. In one embodiment, plates are dimensioned so that the repellant magnetic force induced by the opposing the attached magnets is sufficient to push the plates away from each other and maintain them under the necessary tension and curvature. This aspect reduces noise and driver structural resonance.

BRIEF DESCRIPTION OF THE FIGURES

FIG. 4 is a cross-sectional view of a planar driver in accordance with an embodiment of the present invention.

FIG. 5 is view of a diaphragm without corrugation for use in a planar magnetic driver in accordance with an embodiment of the present invention.

FIG. 6 is a view of a diaphragm with a corrugated peripheral region for use in a planar magnetic driver in accordance with an embodiment of the present invention.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 2:
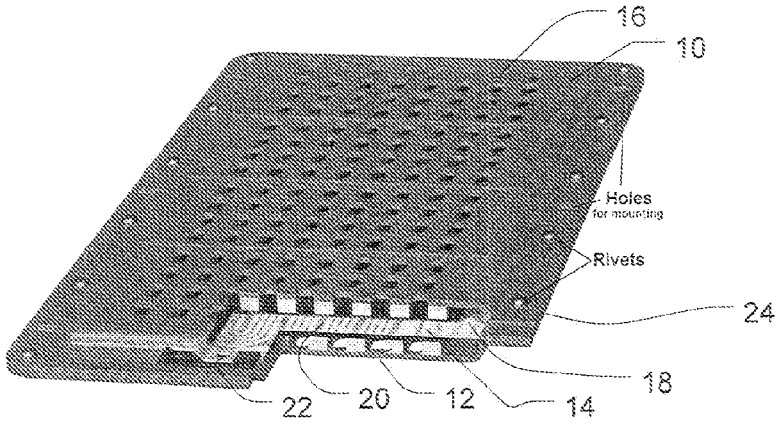
FIG. 2 is a perspective and cut-away view of a planar driver in accordance with an embodiment of the present invention.
Figure 3:
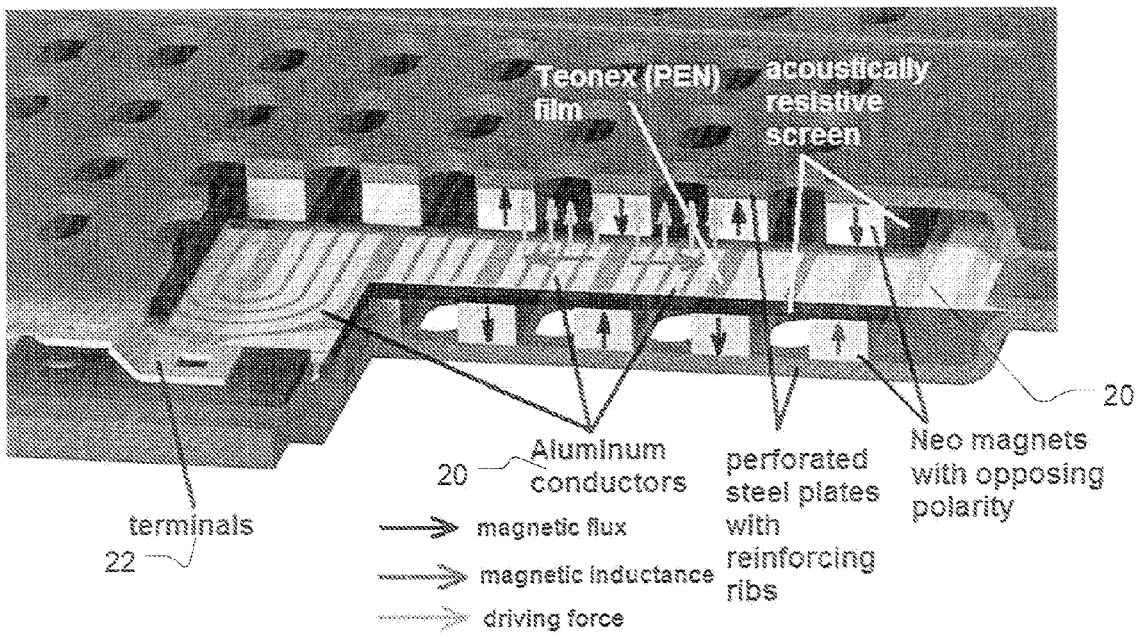
FIG. 3 is a detailed view of a cut-away of a planar driver in accordance with an embodiment of the present invention.

FIGS. 2-6 depict various views of embodiments of a planar driver showing various features of the present invention. FIG. 2 illustrates a perspective and cut-away view of planar driver in accordance with the present invention. FIG. 3 illustrates the cutaway portion of FIG. 2 in further detail, with force arrows showing the directions of magnetic force. Shown here are top and bottom plates 10 with attached magnets 12 on the interior facing surfaces of the plates, with diaphragm 14 disposed therebetween along the edges 24 of the plates 10. Holes 16 are disposed in the plates 10. The diaphragm 14 comprises a foil film 18 and conductors 20 (e.g., aluminium strips). A terminal 22 is coupled to the conductors 20 to provide electrical communication to a signal.

Generally, a clamped diaphragm does not vibrate as a piston. At lower frequencies especially at the fundamental resonance the amplitude of vibrations are much larger in the middle of diaphragm than at the periphery near clamped edges. As shown in FIG. 3, magnets 12 with opposing direction of magnetization generate a repelling force. The repelling force acts on the plates 10 and pushes them away from each other. In accordance with the present invention, the magnets 12 provide a repelling force that pushes the plates 10 away from each other, so that the plates are maintained under biased tension, each plate being in a slightly curved (buckled) or arcuate shape, producing a small rise in the middle of the plates 10 relative to the sides of the plates next to the edges 24. FIG. 4 shows the cross-section of the planar driver across the magnets. Broken lines 42 show the rise in the middle of the plates 10 relative to the edges. The repulsion effect makes magnetic gap between opposing magnets 12 along the medial axis of the plates 10 larger than the magnetic gap between the opposing magnets 12 near the edges 24. The diaphragm 14 produces its lowest frequencies at its largest excursion. Light shaded lines 40 in FIG. 4 show the contour of diaphragm 14 at maximum excursion at fundamental resonance. The maximum possible excursion is limited by magnetic gap geometry, and hence the larger the gap, the lower the fundamental frequency of the driver, and the greater its low frequency extension.

According to one embodiment of the present invention, the plates 10 are made of a sheet metal that has a thickness dimensioned so that under a given repelling force, and for a designed width of the plates, depending on magnets grade and size, the magnetic repulsion of the magnets 12 effect is sufficient to push the plates away from each other within the medial portion thereof, and which thus produces a larger magnetic gap in around middle of the diaphragm. For example, if Hg is the height of magnetic gap between magnets 12 at the outer edges of the driver, then preferably a gap about 1.5-2 Hg is achieved in the middle of the plates due to the flexing of the plates. With a driver size of about 10"×5" (outer dimension) and N35H Neodymium magnet cross-area size of about 4×4 mm, a 1008 CRS steel plate may be used with thickness of about 1.5 m to 2 mm to achieve desired separation under magnetic repulsion. This allows the diaphragm 14 a larger excursion than with convention flat plates 4 and higher maximum SPL output by about 3-6 dB. At the same time the efficiency can be largely retained and construction would use thinner stamped plates without necessity to use expensive cast parts or very thick metal with special arrangements. The plates, while preferably formed from metal, can as well be formed from other relatively dense but flexible materials, including plastics and composites, so that the thickness of the plates given their width, allows for bending in response to the opposing magnetic forces of the magnets 12.

Figure 1:
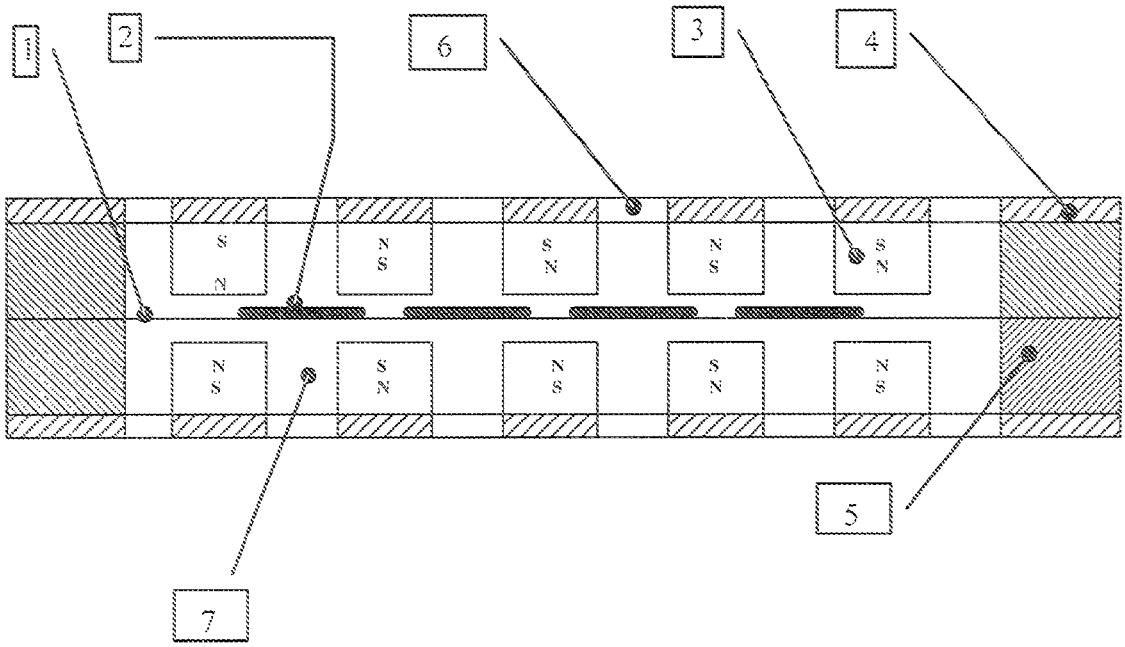
Fig 1. PRIOR ART
FIG. 1 is a cross-sectional view of a conventional planar-magnetic transducer.

One benefit of the plates being buckled under the tension relates to structural vibrations of the plates. In a conventional driver as shown in FIG. 1, when the plates 10 are made of sheet metal and clamped at the edges, they are prone to vibration. At resonances these vibrations can be quite significant producing noise, buzz and making magnets vibrate in relationship to each other. The movement of the magnets 12 in turn acts to modulate magnetic field in the gap and hence affect the reproduced signal, thereby introducing distortion. In accordance with the present invention, placing the plates 10 under the mechanical stress so as to cause them to bend into a curved, arcuate shape greatly reduces their ability to resonate freely. The use of magnetic repulsion effect between the opposing magnets 12 is one way to achieve the desired degree of tension and curvature. This not only eliminates buzz and noise but significantly stabilizes magnetic gap geometry and reduces modulation effects, improving overall sound quality of the driver.

Another aspect of the present invention relates to the construction of the diaphragm 14. Generally, when planar driver operates, power from amplifier is dissipated in the driver and heats the diaphragm. Typically planar diaphragm is very light and as such heats up very quickly. Different coefficients of thermal expansion of the diaphragm layers, consisting of polymer substrate and metal foil, result in generation of tensile stresses in the plane of the diaphragm. Those thermal stresses, when over-imposed on mechanical stresses due to diaphragm vibrations, produce such phenomena as wrinkling and buckling. There are several negative consequences of these phenomena:

- diaphragm looses mechanical stability in those buckled zones. Parts of the membrane began vibrating chaotically, generating parasitic vibrations that manifest themselves as wide band buzz. The buzz can be spectrally located above and below the tones that generated it. This buzz is very objectionable and should be eliminated. Many planar drivers suffer from this effect.
- wrinkling and buckling, if not controlled, lead to de-lamination of conductors from the film and/or developing cracks in the conductors in the areas of maximum stress.
- deformations in the diaphragm may lead to conductors touching the magnets and consequent short circuit that would immediately lead to driver failure. For the same reason, a wrinkled diaphragm will have very limited excursion capability before it hits magnets. Therefore if wrinkles and buckled areas are developed in the operating area of the diaphragm between the magnets, this would severely limit transducer's output capability at low frequency were amplitude of diaphragm's vibration is maximum.

Referring now to the exemplary embodiment of FIGS. 5-6, in order to prevent above described effects the planar driver 14 includes a corrugated region 30 comprising a plurality of corrugations along the periphery of the diaphragm 14 between the conductive elements 18 and the edge 32. FIG. 5 shows the diaphragm 14 prior to corrugation, and FIG. 6 shows the diaphragm after corrugation. In one embodiment, the corrugation is done in a form of ridges and valleys that are transverse to the direction of current carrying conductors. Also, the corrugated region is placed outside of the magnet gap, which allows keeping the geometrical thickness minimal and excursion maximal for the region of diaphragm that is acoustically active. The corrugation is preferably deep with peak to peak distance between indentations on the order of at least 1-2 mm (relative to a diaphragm thickness about 1 mil). The lateral distance between the peaks is about 2 mm as well. In one embodiment, in order to eliminate breaking of metal foil during deep draw corrugation, the metal strips at the periphery are made with a plurality of discrete regions 37, with small gaps 34 between them that reduce stress and allow relatively deep corrugation for thin foil/polymer laminate. The corrugated region can be formed by hot press forming, so as to allow appropriate expansion of the diaphragm material in the corrugated region 30, while maintaining the overall dimensions. Deep corrugation allows maximum stability of the diaphragm, most effective dampening of resonance and significant absorption and reduction of tensile stress associated with diaphragm heating.

The accordion-like corrugation provide significant elasticity in the direction of conductors greatly helps to reduce diaphragm buckling and wrinkling due to heat stress by absorbing those stresses. Another benefit of using such corrugation is that it provides lower fundamental resonance of the diaphragm Fs and as such lower operating frequency, thereby further extending the low frequency response. The resonance Fs depends on the longest dimension of the diaphragm, its degree of tensioning, material properties etc. Providing greater flexibility along the longest dimension thus allows lower Fs with other factors being equal.

Yet another benefit of the above corrugation is greatly improved dampening without the need to corrugate the whole area of the diaphragm. Thin stretched membranes as mechanical bodies have very negligible bending stiffness and constructional dampening. In many cases materials used in planar driver diaphragms (polymer film and aluminum foil) have rather low internal dampening. Thus, it is desirable to introduce additional dampening in the diaphragm. This dampening if possible should be of a constructional nature using diaphragm material itself without adding any coatings that greatly increase diaphragm mass. One of the most effective constructional dampening is corrugation. Deep corrugation according to the present invention allows very effective dampening of diaphragm resonances without introducing the problem associated with the use additional dampening materials.

What is claimed is:

1. A planar magnetic driver comprising:

top and bottom plates having respective interior facing surfaces;

top and bottom magnets located on the interior facing surfaces of the top and bottom plates, the top and bottom magnets positioned such that a repellant magnetic force is induced between the top and the bottom magnets, the repellant magnetic force biasing the top and bottom plates away from each other and maintaining each of the plates in an arcuate shape; and a diaphragm positioned between the top and bottom plates having electrical conductors, the diaphragm configured to vibrate responsive to an electrical signal applied to the electrical conductors interacting with a magnetic field induced by the top and bottom magnets.

2. The planar magnetic driver of claim 1, wherein the top and bottom plates each have respective side edges, and the side edges are clamped to each other.

3. The planar magnetic driver of claim 2, wherein there is a magnetic gap between the top magnets and the bottom magnets, and wherein the magnetic gap between the top and bottom magnets proximal a medial axis of the top and bottom plates is greater than the magnetic gap between the top magnets and the bottom magnets disposed proximal the side edges.

4. The planar magnetic driver of claim 3, wherein the magnetic gap between the top and bottom magnets proximal the medial axis of the top and bottom plates is approximately 1.5 to 2 times greater than the magnetic gap between the top magnets and the bottom magnets disposed proximal the side edges.

5. The planar magnetic driver of claim 3, wherein the top and bottom plates are dimensioned such that excursion of the diaphragm within the gap is substantially maximized during vibration of the diaphragm.

6. The planar magnetic driver of claim 1, wherein the top and bottom plates are dimensioned such that the repellant magnetic force induced by the top and bottom magnets creates mechanical tension across surfaces of the top and bottom plates.

7. The planar magnetic driver of claim 6, wherein the top and bottom plates are dimensioned such that resonance of the top and bottom plates is dampened by the mechanical tension across the surfaces of the top and bottom plates.

* * * * *